US008117773B2

(12) United States Patent
Seda et al.

(10) Patent No.: US 8,117,773 B2
(45) **Date of Patent: *Feb. 21, 2012**

(54) DUAL CYLINDER DUAL PICK-UP COUPLER

(75) Inventors: Anthony Seda, Akron, OH (US); Robert Sikorski, Tallmadge, OH (US)

(73) Assignee: Paladin Brands Group, Inc., Cedar Rapids, IA (US)

( * ) Notice: Subject to any disclaimer, the term of this patent is extended or adjusted under 35 U.S.C. 154(b) by 58 days.

This patent is subject to a terminal disclaimer.

(21) Appl. No.: 12/603,109

(22) Filed: Oct. 21, 2009

(65) Prior Publication Data

US 2010/0104359 A1 Apr. 29, 2010

Related U.S. Application Data

(60) Provisional application No. 61/109,089, filed on Oct. 28, 2008.

(51) Int. Cl.
*E02F 3/96* (2006.01)

(52) U.S. Cl. ..... 37/468; 37/403; 414/723

(58) Field of Classification Search ..... 37/468, 37/403, 442, 443; 403/24, 322.1, 408.1, 403/345, 359.1, 359.5; 414/723, 912; 172/683, 172/272, 275, 810, 245, 250
See application file for complete search history.

(56) References Cited

U.S. PATENT DOCUMENTS 3,243,066 A * 3/1966 Gardner et al. ..... 414/698
3,272,264 A * 9/1966 Antolini ..... 172/273
3,705,656 A * 12/1972 Hunger et al. ..... 414/723
3,760,883 A 9/1973 Birk
4,208,163 A * 6/1980 Holmqvist ..... 414/723
4,243,356 A 1/1981 Takojima
4,586,867 A * 5/1986 Stafford ..... 414/723
4,708,579 A 11/1987 Baird et al.
4,812,103 A 3/1989 Cochran et al.
4,963,071 A 10/1990 Larwin et al.
5,010,962 A * 4/1991 Bloom, Jr. ..... 172/430
5,049,027 A * 9/1991 Morrison et al. ..... 414/723
5,088,882 A * 2/1992 Lovitt, Jr. ..... 414/723
5,310,275 A * 5/1994 Lovitt ..... 403/322.3
5,415,235 A 5/1995 Gebauer
5,529,419 A * 6/1996 Gebauer ..... 403/24
5,590,483 A 1/1997 Kim
5,692,850 A * 12/1997 Kimble et al. ..... 403/24
5,732,488 A * 3/1998 Smith ..... 37/468
5,820,332 A 10/1998 Philips et al.
5,865,594 A * 2/1999 Kim ..... 414/723
6,196,595 B1 * 3/2001 Sonerud ..... 285/26
6,227,792 B1 5/2001 Baker et al.
6,386,822 B1 5/2002 Burr (Continued)

*Primary Examiner* — Thomas Beach
*Assistant Examiner* — Matthew Buck
(74) *Attorney, Agent, or Firm* — Fay Sharpe LLP

(57) ABSTRACT

A loader coupler includes a body with spaced-apart inner rib mounts for mating respectively with ribs of a first type of attachment. The body also includes inner locking regions that are vertically aligned with the inner rib mounts. Spaced-apart outer rib mounts are also provided on the body and are adapted to mate respectively with a second type of attachment. Outer locking regions are vertically aligned with the outer rib mounts. A lock system is connected to the body and includes: (i) a first actuator operatively connected to left and right first lock plungers and adapted to move the left and right first lock plungers between locked and unlocked positions; and, (ii) a second actuator operatively connected to left and right second lock plungers and adapted to move the left and right second lock plungers between locked and unlocked positions.

12 Claims, 7 Drawing Sheets

U.S. PATENT DOCUMENTS 6,860,706 B2 3/2005 Godwin et al.
6,886,279 B2 * 5/2005 Kimble ..... 37/468
6,899,509 B1 * 5/2005 Mailleux ..... 414/723
6,991,398 B2 * 1/2006 Leemans et al. ..... 403/324
7,014,385 B2 3/2006 Lim et al.
7,182,546 B1 * 2/2007 Kimble ..... 403/322.3
7,225,566 B1 * 6/2007 Kimble ..... 37/468
7,337,564 B2 * 3/2008 Kimble ..... 37/468
7,836,616 B2 * 11/2010 Esser et al. ..... 37/468
2008/0141566 A1 6/2008 Esser et al.

* cited by examiner

DUAL CYLINDER DUAL PICK-UP COUPLER

CROSS-REFERENCE TO RELATED APPLICATION

This application claims priority from and benefit of the filing date of U.S. provisional application Ser. No. 61/109,089 filed Oct. 28, 2008, and the entire disclosure of said provisional application is hereby expressly incorporated by reference into the present specification.

BACKGROUND

Loader machines such as front-end loaders and tractor-loaders (each of which is sometimes referred to herein generally as a "loader") often include a quick coupler operatively connected to the arms and control linkage thereof. The coupler is adapted to mate selectively and releasably with an attachment for performing work, such as a construction attachment or agricultural attachment (e.g., a bucket, a boom, a fork attachment, a rake, or the like). The coupler allows an operator of the loader to engage with and disengage from various attachments as needed without exiting the operator's cab. Such couplers provide for improved machine productivity and operator convenience as compared conventional loaders that require each attachment to be connected to and disconnected from the loader arms and control linkage using sliding pins in a so-called "pin-on" connection.

Each attachment must include a receiver structure that is adapted to be engaged by and mate with the coupler. In a basic form, the receiver must have a single, particular configuration to mate with the coupler. More recently, "hybrid" or "multi pick-up" couplers have been developed that are adapted to mate with two different receiver configurations. These multi pick-up couplers are desirable due to their ability to mate with attachments that have with a first and second receiver structure.

A need has been identified for a multi pick-up coupler with an improved lock system for selectively capturing the attachments to the coupler.

SUMMARY

In accordance with one aspect of the present development, a coupler for a front-end loader or other loader includes a body comprising a front region, a rear region, an upper region, a lower region, left and right lateral sides, a tilt actuator pin-on location, and left and right arm pin-on locations. Left and right laterally spaced-apart inner rib mounts are provided on the body and are adapted to mate respectively with left and right ribs of a first type of attachment receiver structure. Left and right inner locking regions are defined by the body and are vertically aligned with the left and right inner rib mounts, respectively. Left and right laterally spaced-apart outer rib mounts provided on the body and are adapted to mate respectively with left and right ribs of a second type of attachment receiver structure. Left and right outer locking regions are defined by the body and are vertically aligned with the left and right outer rib mounts, respectively. A lock system is connected to the body and includes: (i) a first actuator operatively connected to left and right first lock plungers and adapted to move the left and right first lock plungers between locked and unlocked positions; and, (ii) a second actuator operatively connected to left and right second lock plungers and adapted to move the left and right second lock plungers between locked and unlocked positions.

In accordance with another aspect of the present development, a lock system is provided for releasably capturing an associated attachment comprising either a first type of attachment receiver structure or a second type of attachment receiver structure to loader coupler body. The lock system includes: (i) a first actuator operatively connected to left and right first lock plungers and adapted to move the left and right first lock plungers between locked and unlocked positions; and, (ii) a second actuator operatively connected to left and right second lock plungers and adapted to move the left and right second lock plungers between locked and unlocked positions.

DETAILED DESCRIPTION

Figure 1:
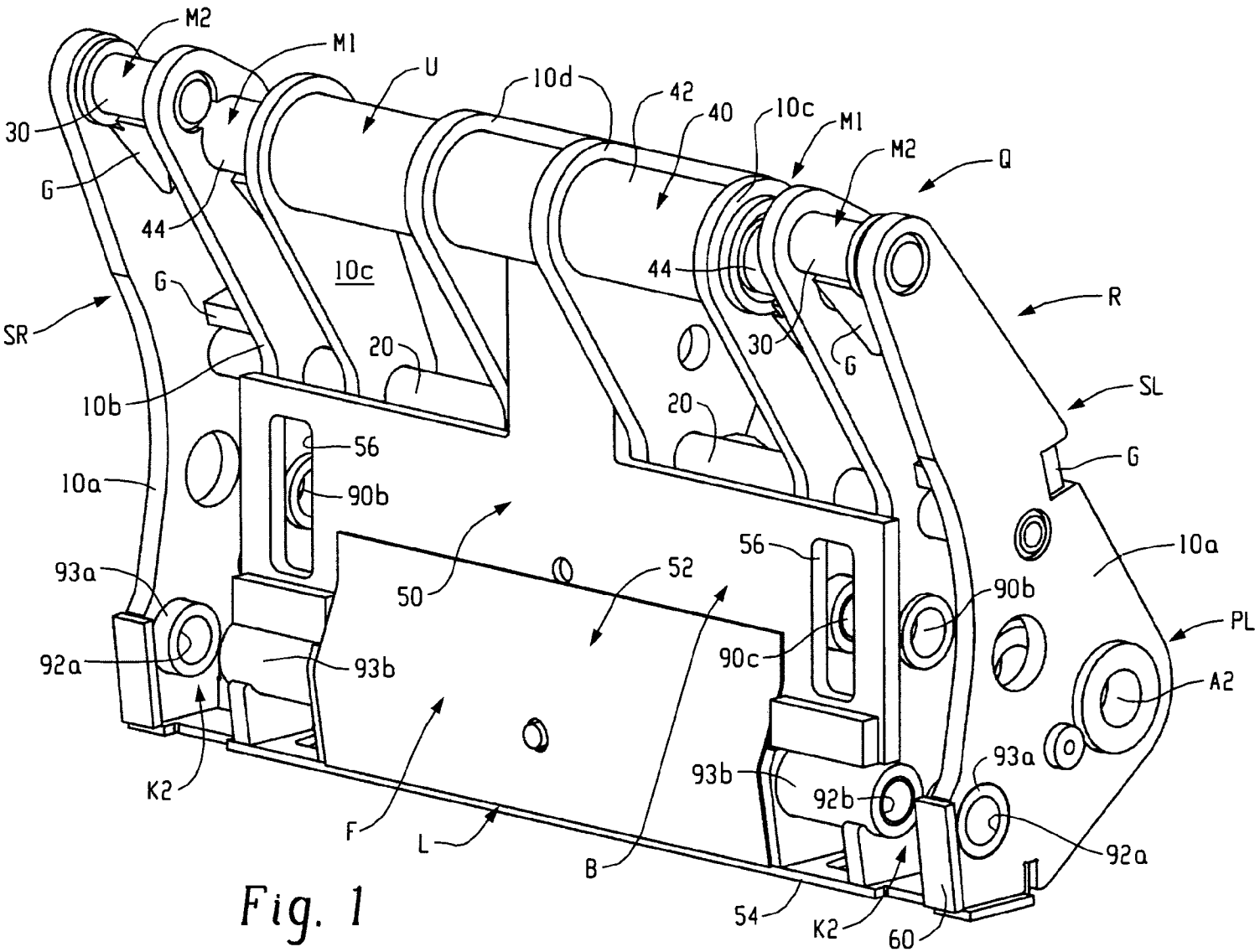
FIGS. 1 and 2 are respective front and rear isometric views of an attachment quick coupler formed in accordance with the present development.
Figure 2:
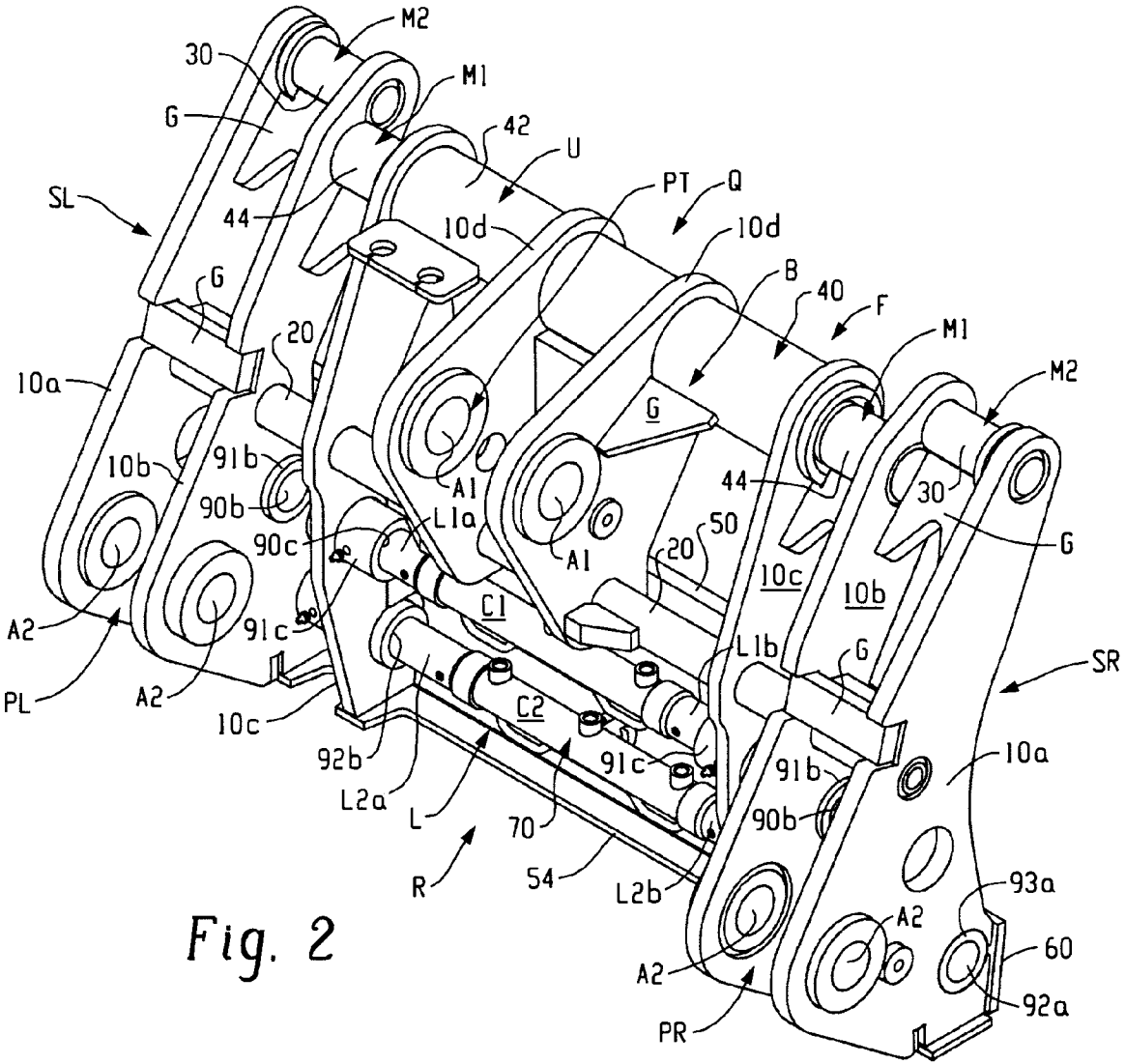
Figure 3:
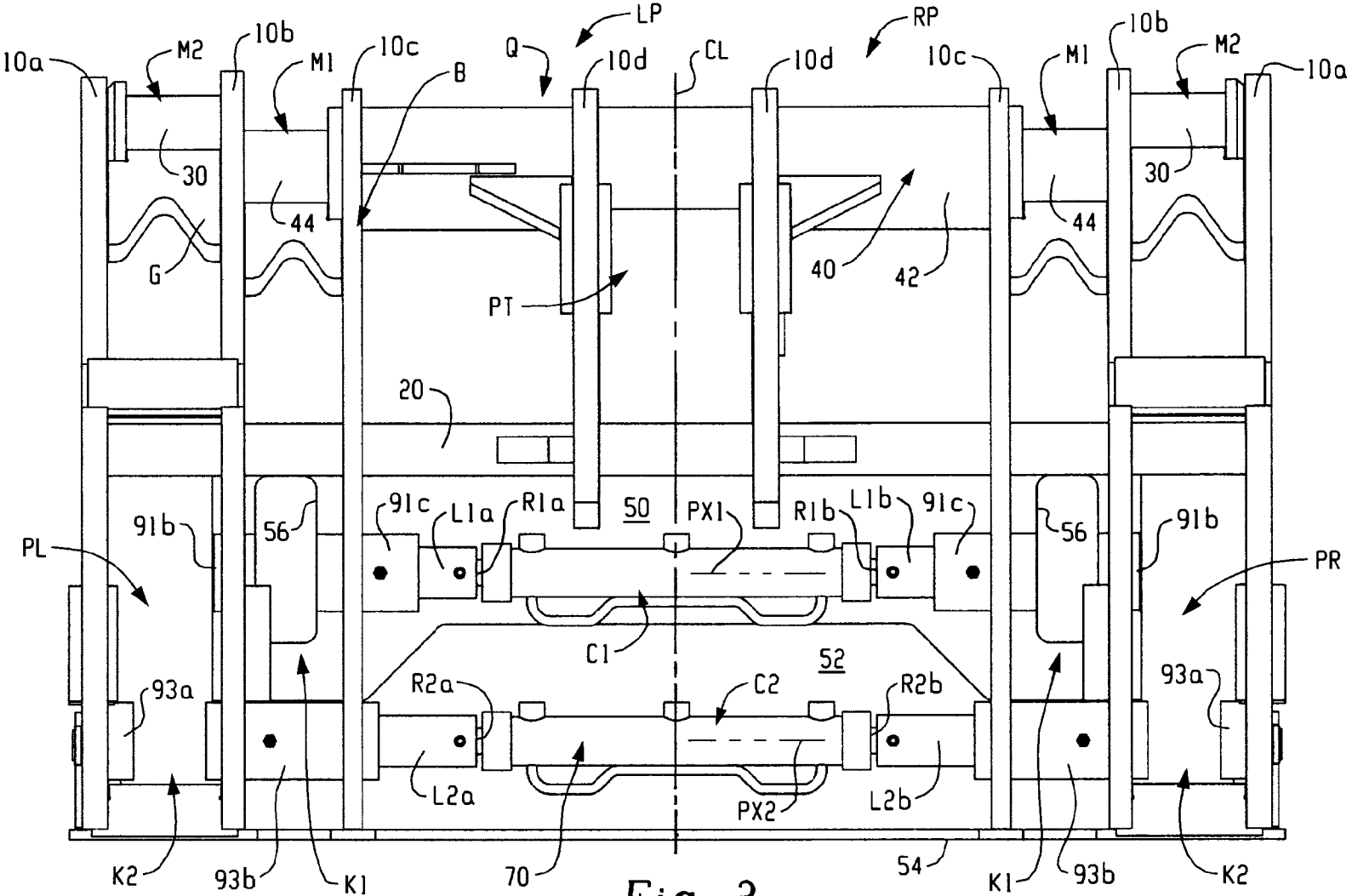
FIGS. 3 and 4 are respective rear and front views of the coupler of FIGS. 1 and 2, with the coupler in its unlocked configuration or condition.
Figure 4:
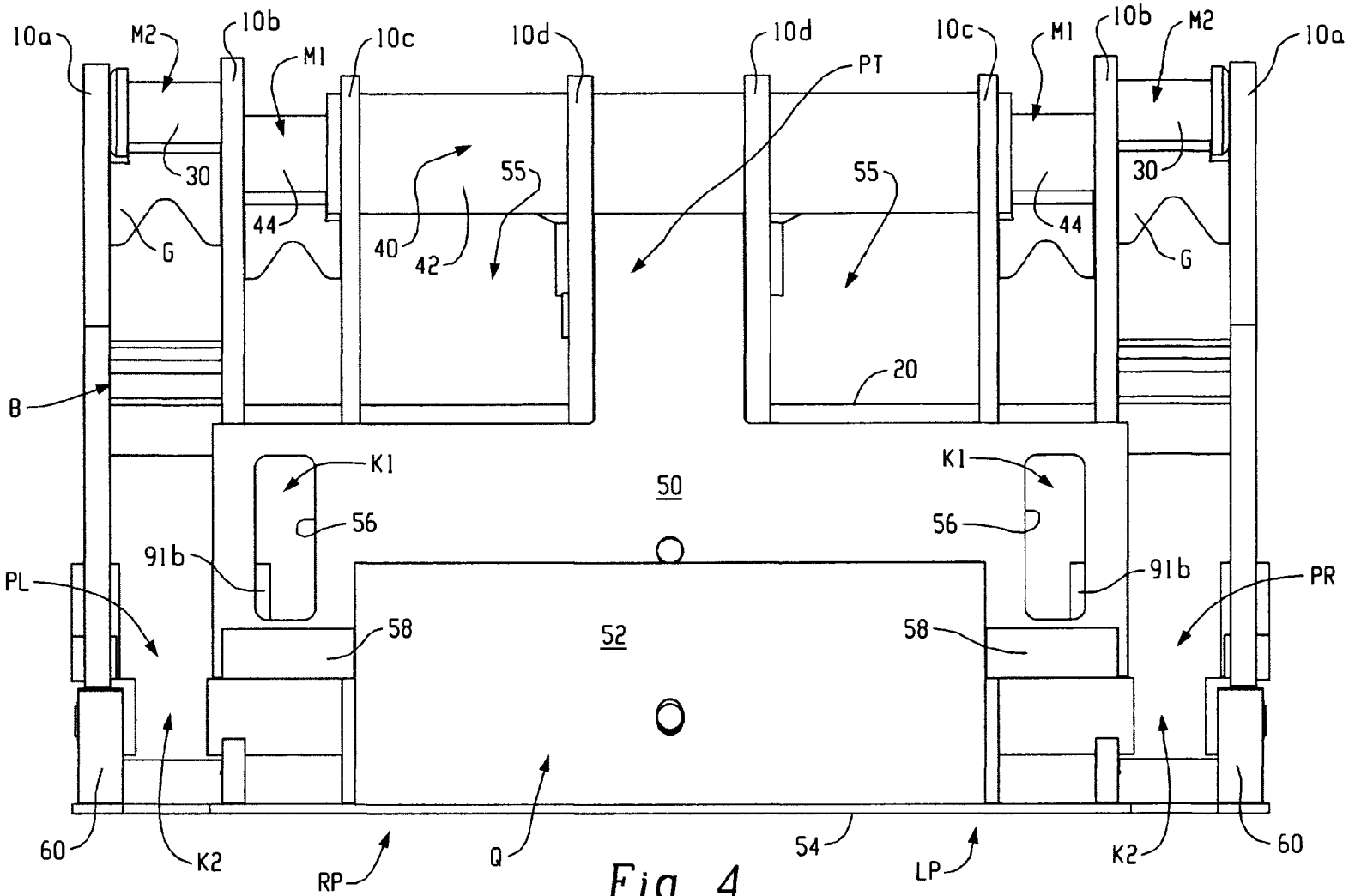

FIGS. 1 and 2 are respective front and rear isometric views of an attachment quick coupler Q formed in accordance with the present development. The coupler Q comprises a frame or body B that has a rear (machine) side R and a front (attachment) side F, left and right lateral sides SL,SR, and upper and lower regions U,L. FIGS. 3 and 4 are rear and front views of the quick coupler Q.

In the illustrated embodiment, as also shown in FIG. 3, the body B is symmetrically constructed about a vertical center line CL, at least with respect to the basic structure as described herein, so as to include symmetrical left and right portions LP,RP defined between the centerline CL and the left and right lateral sides SL,SR, respectively.

Referring to all of FIGS. 1-4, the body B is constructed from steel alloy or other metal components that are welded, fastened and/or otherwise connected. More specifically, the body B comprises multiple spaced-apart vertical ribs defined by steel plates or other members. In the illustrated embodiment, the left and right coupler portions LP,RP each comprise first, second, third, and fourth vertical spaced-apart ribs 10*a*, 10*b*, 10*c*, 10*d*. The ribs 10*a*-10*d* are preferably all arranged in parallel, spaced-apart relation to each other.

The two innermost (fourth) ribs 10*d* define a tilt actuator pin-on location PT by which and where the associated loader tilt-link or cylinder rod eye or other tilt actuator of the loader control linkage is operatively and pivotally secured to the coupler body B. The ribs 10*d* define a channel between themselves and the ribs 10*d* include respective apertures A1 (defined in respective bosses) that are aligned with each other. An associated control linkage tilt actuator such as a tilt-link, rod-eye or the like of a loader or other associated machine to which the coupler body B is connected is inserted in the channel between the ribs 10*d* and pinned in position by a pin inserted into the aligned apertures A1 and through a bore defined in the associated tilt actuator to allow pivoting movement of the ribs 10*d* and, thus, the coupler body B relative to the associated tilt actuator.

The rear R of the coupler body B further comprises left and right arm pin-on locations PL,PR by which the coupler body is operatively connected to associated left and right arms of a loader or other associated machine, respectively, for pivoting movement of the body relative to the associated machine arms. In the illustrated embodiment, the outermost two ribs 10*a*,10*b* of the left/right coupler portions LP/RP define a channel therebetween that is adapted to receive the associated left/right machine arms. The ribs 10*a*,10*b* include respective aligned apertures A2 (defined in respective bosses) and the associated arms are secured to the coupler body B by insertion of pins through the aligned apertures A2 of the pin-on locations PL,PR and through an aligned bore in the associated machine arm.

In the illustrated example, the coupler body B comprises only a single tilt actuator pin-on location PT that is centrally located between the left and right arm pin-on locations PL,PR. In an alternative embodiment, the coupler body B comprises left and right laterally spaced-apart tilt actuator pin-on locations that are part of the left and right coupler portions LP,RP, respectively. In one example, these left and right tilt actuator pin-on locations are defined between the outer ribs 10*a*,10*b* of the left and right coupler portions LP,RP, with a structure corresponding to the left and right arm pin-on locations PL,PR, aligned with but spaced respectively above the arm pin-on locations PL,PR. With such an alternative structure, the coupler body B is adapted to be operably coupled to associated left and right machine arms at the locations PL,PR and is also adapted to be operably coupled to associated left and right tilt actuators at the left and right tilt actuator pin-on locations, for example for use with a tool-carrier type loader machine.

A central support bar 20, preferably one-piece, extends laterally between and interconnects all of the vertical ribs 10*a*, 10*b*, 10*c*, 10*d* across both the left and right coupler portions LP,RP, i.e., the central support bar 20 is located between the upper and lower regions U,L of the coupler body B and extends between and is connected to the first rib 10*a* of the left portion LP and also the first rib 10*a* of the right portion RP, and is connected to every rib 10*b*, 10*c*, 10*d* located therebetween. As shown, the central support bar 20 is a one-piece section of cylindrical bar stock, but other shapes can be used, and/or a multi-piece support bar can be used instead.

Left and right outer cross-bars 30 extend between and interconnect the first and second ribs 10*a*,10*b* for both the left and right coupler portions LP,RP, respectively. These outer cross-bars 30 are located adjacent the upper edge U of the body B and are defined by cylindrical bar stock or like member having a cylindrical outer surface.

The coupler body B further comprises a main upper support 40 that extends between and is connected to the third and fourth ribs 10*c*,10*d* of both the left and right coupler portions LP,RP and that extends between and interconnects the innermost (fourth) ribs 10*d* of the left and right coupler portions LP,RP. The main upper support 40 is located adjacent the upper edge U of the body. In the illustrated embodiment, the main upper support 40 comprises a central one-piece tubular member 42 that is connected to both the innermost ribs 10*d* of the left/right coupler portions LP,RP and that extends laterally outward toward the left and right sides SL,SR of the body, extending through and connected to the left/right third ribs 10*c*.

Left and right inner cross-bars 44 are located between the second and third ribs 10*b*,10*c* of the left and right coupler portions LP,RP, respectively, adjacent the upper edge U of the body B. The left/right inner cross-bars 44 have respective outer ends installed in an aperture defined in the left/right second ribs 10*b*, and have respective inner ends that are, in the illustrated embodiment, installed within open left/right ends of the central tubular member 42. The left and right inner cross-bars 44 are preferably defined by cylindrical bars or other members having a cylindrical outer surface.

A main face plate 50 extends laterally from the second rib 10*b* of the left coupler portion LP to the second rib 10*b* of the right coupler portion RP. The main face plate 50 extends in a general vertical direction from a location adjacent the main upper support 40 between the fourth ribs 10*d* toward the body lower edge L. The main face plate 50 is connected to the second, third, and fourth ribs 10*b*, 10*c*, 10*d* of both the left and right coupler portions LP,RP so as to tie the left and right coupler portions together. The face plate 50 is preferably a one-piece steel plate construction. A generally horizontal foot plate 54 is arranged transverse to the face plate 50 and is connected to all of the ribs 10*a*, 10*b*, 10*c*, 10*d* of both sides LP,RP of the body B. The foot plate 54 is connected to the bottom edge of each rib 10*a*, 10*b*, 10*c*, 10*d* so as to define a planar surface or base adjacent the lower edge L of the body B. A second, lighter-weight contoured face plate or shield 52 is connected to both the main face plate 50 and the foot plate 54 and extends therebetween. The second face plate 52 extends laterally between the third rib 10*c* of the left portion LP and the third rib 10*c* of the right portion RP.

The coupler body B includes numerous other support bars/ribs/gussets G as shown in the drawings for added strength and rigidity as will be readily understood by one of ordinary skill in the art. The face plate 50 is shaped so that one or more sight openings 55 are defined between the ribs 10*a*, 10*b*, 10*c*, 10*d* and the face plate 50 to allow an operator to see through the face plate 50 from the rear side R of the coupler body B to the front side F during coupling/decoupling operations.

For both the left and right coupler portions LP,RP, between the second and third ribs 10*b*,10*c*, the body B comprises first or inner rib pick-up points or rib mounts M1 that, in the illustrated embodiment, are defined by the inner cross-bars 44, preferably by a cylindrical surface thereof. Similarly, for both the left and right coupler portions LP,RP, between the first and second ribs 10*a*,10*b*, the body B comprises second or outer rib pick-up points or rib mounts M2 that are defined by the outer cross-bars 30, preferably by a cylindrical surface thereof. The left and right outer rib mounts M2 are respectively aligned with but spaced from the left and right arm pin-on locations PL,PR. The left and right inner rib mounts M1 are vertically offset relative to the left and right outer rib mounts M2. As shown, the left and right inner rib mounts M1 are spaced below the left and right outer rib mounts M2 as compared at their centers or relative to a reference point on the body such as the base plate 54.

Figure 5A:
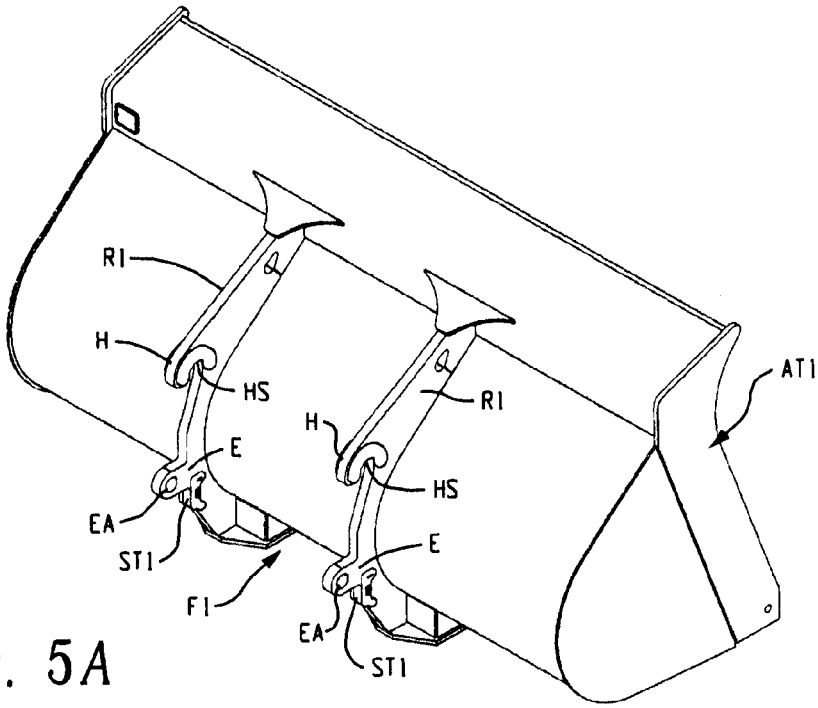
FIG. 5A is a rear isometric view of an attachment including a first type of receiver structure for mating with the coupler of FIGS. 1-4
Figure 5B:
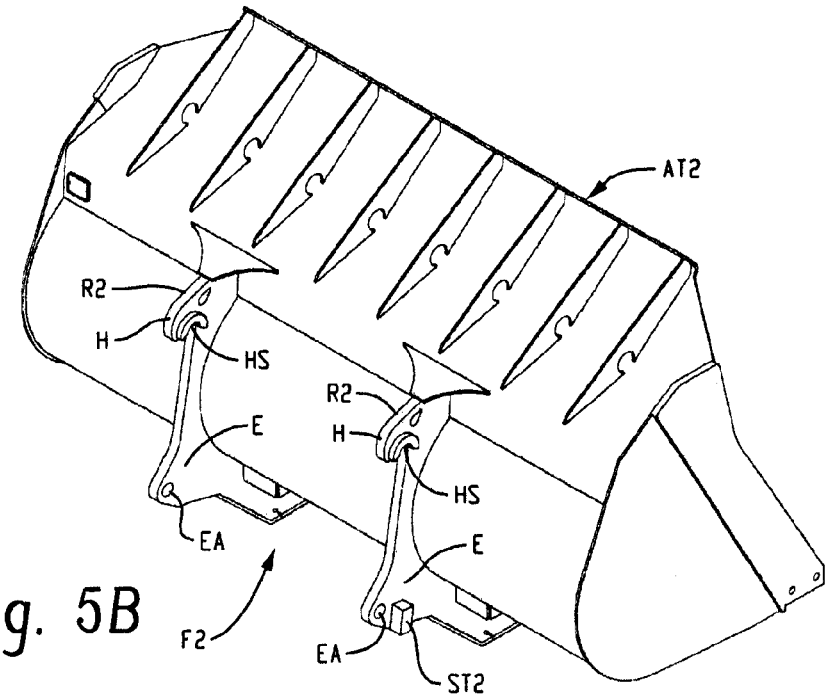
FIG. 5B is a rear isometric view of an attachment including a second type of receiver structure for mating with the coupler of FIGS. 1-4.

As described in more detail below, the left and right inner mounts M1 are adapted to mate with first type of attachment coupling or attachment receiver structure F1 (FIG. 5A) comprising left and right female ribs R1 connected to a bucket or other attachment AT1. The left and right outer mounts M2 are adapted to mate with a second type of attachment coupling or attachment receiver structure F2 (FIG. 5B) connected to a bucket or other attachment AT2. The second type of attachment receiver structure comprises left and right female ribs R2 that are shaped and dimensioned differently as compared to the female ribs R1 of the structure F1 and that are spaced-apart a different distance as compared to the spacing of the ribs R1 of the structure F1. For both the receiver structures F1,F2, the female ribs R1,R2 each comprise a hook portion H that opens downward and comprises an inner cylindrical surface HS and an eye portion E spaced vertically below the hook portion H and comprising a laterally extending lock aperture EA that extends completely through the rib R1,R2. The hook portions H of the left/right female ribs R1 of the first type of attachment receiver structure F1 are adapted to mate respectively with the left/right inner rib mounts M1 of the coupler Q so that the left/right cylindrical hook surfaces HS closely abut corresponding cylindrical surfaces of the left/right mounts M1. Similarly, the hook portions H of the left/right female ribs R2 of the second type of attachment receiver structure F2 are adapted to mate respectively with the left/right outer rib mounts M2 of the coupler Q so that the left/right cylindrical hook surfaces HS closely abut corresponding cylindrical surfaces of the left/right mounts M2. In one example, the first type of attachment receiver structure F1 is a JRB 416 structure and the second type of attachment receiver structure F2 is according to ISO 23727, but these examples are not meant to be limiting in any way. Other examples of attachment receiver structures that can be mated with the coupler Q include John Deere 416, John Deere Hi-Viz, JRB ISO, Volvo ISO, JCB, Komatsu 416, CAT IT.

With continuing reference to FIG. 3, the left and right portions LP,RP of the coupler body B each further comprise an inner locking region such as a channel K1 defined between the second and third ribs 10*b*,10*c* and spaced vertically below the inner rib mounts M1 which are also located between the second and third ribs 10*b*,10*c* as described above. Because the inner locking channels K1 are located behind the face plate 50 (in the illustrated embodiment), the face plate 50 includes left and right inner lock channel openings 56 (see also FIG. 4) that open into the left and right locking channels K1 between the second and third ribs 10*b*,10*c*. Also, the face plate 50 comprises left and right inner stop surfaces or blocks 58 connected thereto or defined as a part thereof and located adjacent the left and right lock channel openings 56, respectively. The left and right inner stop blocks 58 are abutted by the stops ST1 of the ribs R1 of the attachment receiver structure F1 when the ribs R1 are fully mated with the coupler Q.

The left and right portions LP,RP of the coupler body B each further comprise outer locking regions such as channels K2 (FIGS. 3,4) defined between the first and second ribs 10*a*,10*b* and spaced vertically below the outer rib mounts M2 which are also located between the first and second ribs 10*a*,10*b* as described above. In the illustrated embodiment, the outer locking channels K2 open to the front F (and rear R) of the coupler body B without obstruction by the face plates 50,52. The left and right first ribs 10*a* of the coupler body B include or define left and right outer stop blocks/surfaces 60 adjacent the outer locking channels K2. The stop surfaces 60 are abutted by the stops ST2 of the ribs R2 of the attachment receiver structure F2 when the ribs R2 are fully mated with the coupler Q.

When the female ribs R1 of the first type of attachment receiver structure F1 are fully mated with the inner coupler mounts M1, the eye portions E of the left and right female ribs R1 project into the left and right inner locking channels K1 through the lock channel openings 56 with stops ST1 of the left and right female ribs R1 abutted with the left and right stop blocks 58, respectively. Alternatively, in a corresponding fashion, when the female ribs R2 of the second type of attachment receiver structure F2 are fully mated with the outer coupler mounts M2, the eye portions E of the left and right female ribs R2 extend between the ribs 10*a*,10*b* into the left and right outer locking channels K2 with stops ST2 of the left and right female ribs R2 abutted with the left and right stop surfaces 60, respectively.

Figure 6:
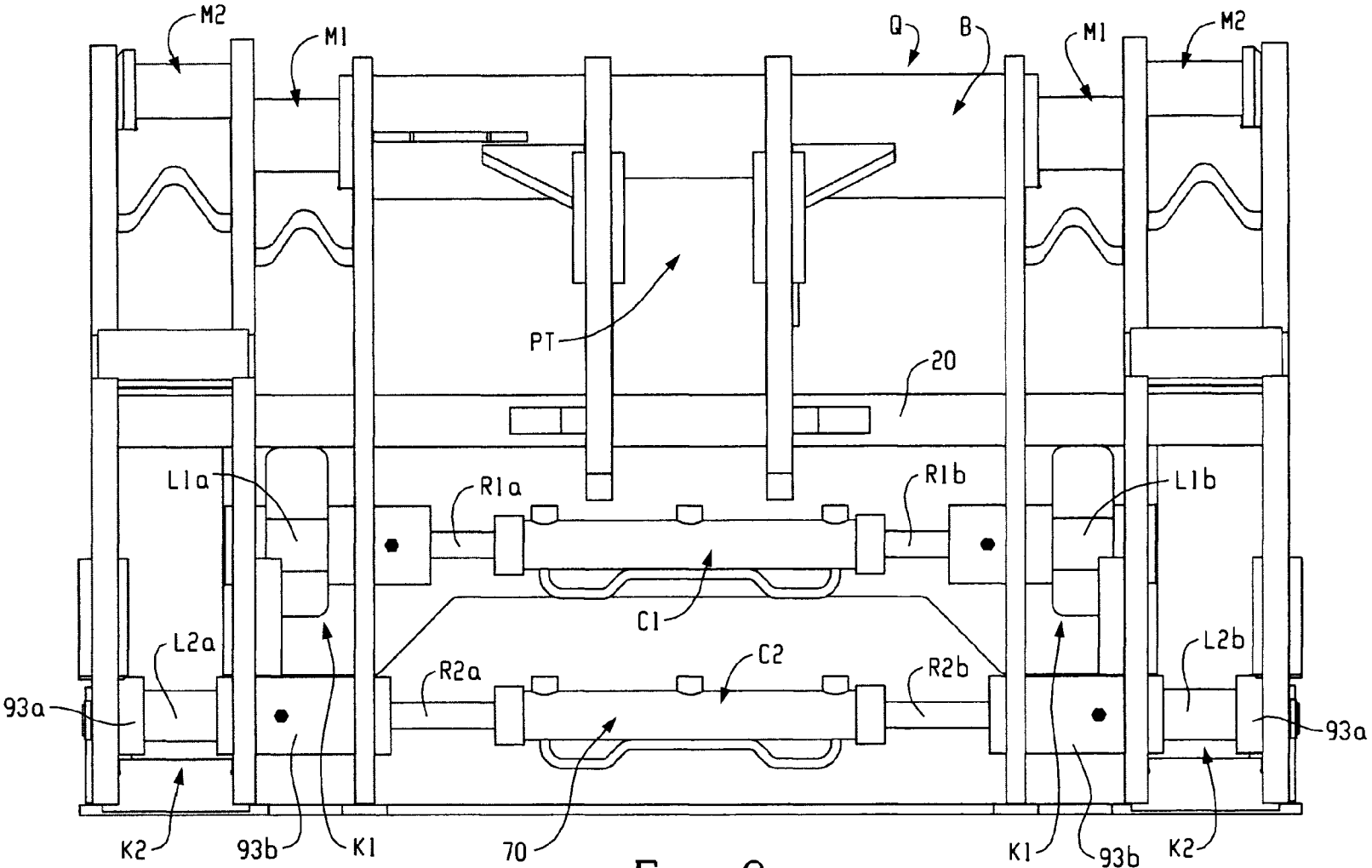
FIGS. 6 and 7 are respective rear and front views of the coupler of FIGS. 1-4, with the coupler in its locked configuration or condition.
Figure 7:
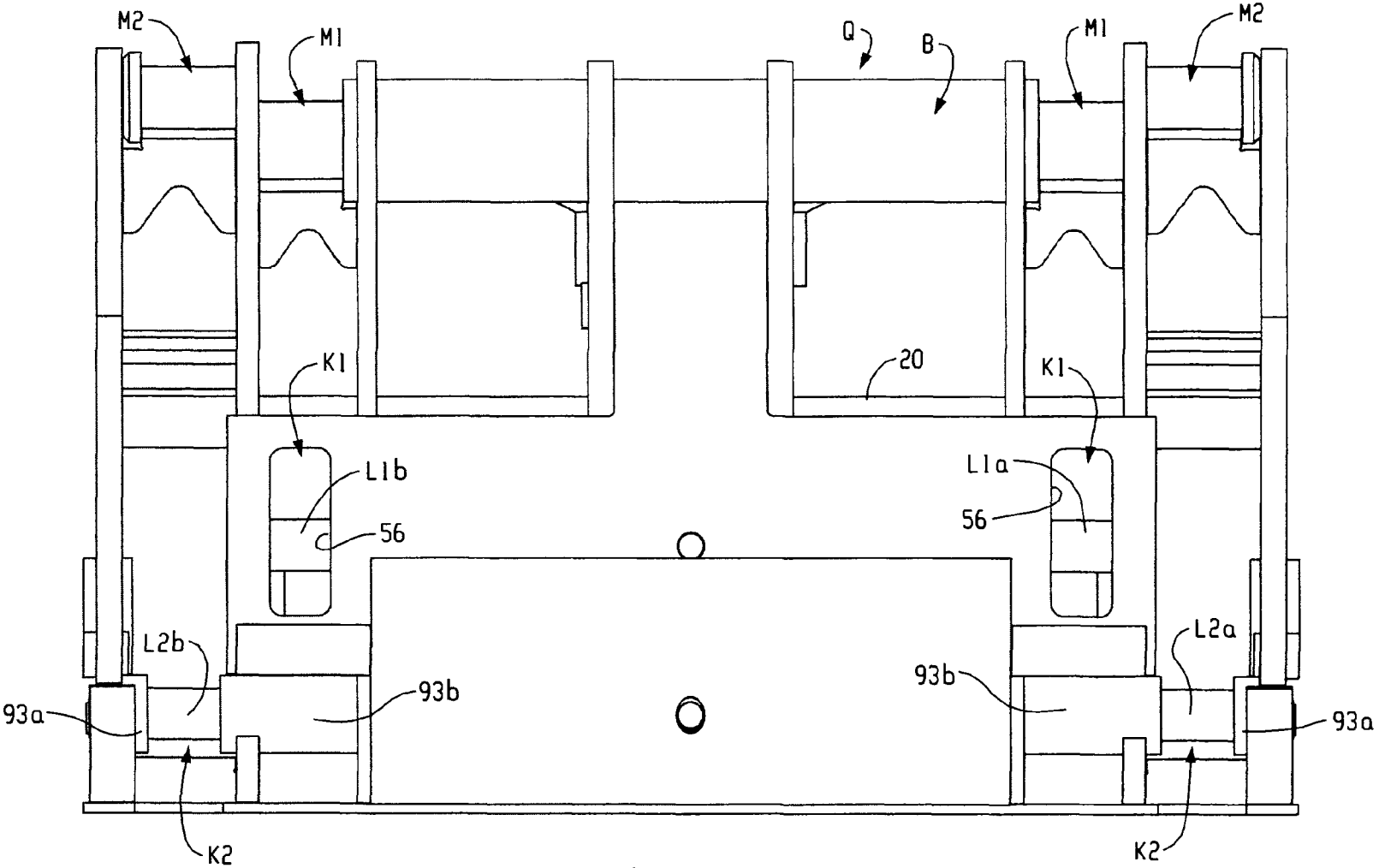

To releasably secure the first type of attachment receiver structure F1 (and the attachment AT1 connected thereto) to the coupler body B, or to releasably secure the second type of attachment receiver structure F2 (and the attachment AT2 connected thereto) to the coupler body B, the quick coupler Q further comprises a lock system 70. In the illustrated embodiment, with reference to FIGS. 2 and 3, the lock system 70 comprises first and second lock actuators C1,C2, each of which is a hydraulic cylinder or other actuator (as such, the actuators C1,C2 are sometimes referred to herein as cylinders C1,C2). In the illustrated preferred embodiment, the first lock actuator C1 is a double rod-end hydraulic cylinder that comprises left and right rods R1*a*,R1*b* that are selectively movable by fluid pressure to and between a retracted position (FIGS. 2,3) to an extended position (FIG. 6), and the second lock actuator C2 is a double rod-end hydraulic cylinder that comprises left and right rods R2*a*,R2*b* that are selectively movable by fluid pressure to and between a retracted position (FIGS. 2,3) to an extended position (FIG. 6). The rods R1*a*, R1*b* of the first actuator C1 move between the retracted and extended positions along a first plunger axis PX1 (FIG. 3); the rods R2*a*,R2*b* of the second actuator C2 move between the retracted and extended positions along a second plunger axis PX2 (FIG. 3) that is parallel to and spaced-apart from the first plunger axis PX1. The rods R1*a*,R1*b* of the first actuator C1 and the rods R2*a*,R2*b* of the second actuator C2 preferably move simultaneously between their retracted and extended positions, for each actuator C1,C2, i.e., the rods R1*a* and R1*b* preferably move in unison with each other and the rods R2*a* and R2*b* preferably move in unison with each other. Also, it is preferred that the actuators C1,C2 are simultaneously actuated in unison such that operation of one actuator C1,C2 is simultaneous with actuation of the other, whether moving all rods from the retracted to extended position or vice versa. The actuators C1,C2 are mounted adjacent and behind the face plates 50,52. Alternatively, the actuators C1, C2 are independently actuated and controlled such that one actuator or the other can be actuated for extension or retraction of its left and right rods while the other actuator is not actuated or otherwise affected.

The left and right rods R1*a*,R1*b* of the first cylinder C1 are respectively operably connected to left and right first lock plungers L1*a*,L1*b* that extend coaxially along the first plunger axis. The left and right rods R2*a*,R2*b* of the second cylinder C2 are respectively operably connected to left and right second lock plungers L2*a*,L2*b* that extend coaxially along the second plunger axis. The lock plungers L1*a*, L1*b*, L2*a*, L2*b* are each preferably defined by respective cylindrical members. FIG. 3 shows the left and right rods R1*a*,R1*b* of the first cylinder C1 retracted so that the respective first lock plungers L1*a*,L1*b* are each in an unlocked position, and FIG. 3 also shows the left and right rods R2*a*,R2*b* of the second cylinder C2 retracted so that the respective second lock plungers L2*a*, L2*b* are each in an unlocked position. FIG. 6 is the same as FIG. 3 but shows the rods R1*a*,R1*b* and R2*a*,R2*b* of cylinders C1,C2 extended so that the respective first lock plungers L1*a*,L1*b* and second lock plungers L2*a*,L2*b* are each in a locked position.

In the illustrated embodiment, the vertical spacing between the first plunger axis PX1 and the left and right inner rib mounts M1 is less than the vertical spacing between the second plunger axis PX2 and the left and right outer rib mounts M2 to account for the differences in spacing between the hook portion H and lock aperture EA for the ribs R1 of the first attachment receiver structure F1 as compared to the ribs R2 of the second attachment receiver structure F2. This relationship can be reversed if needed depending upon the particular first and second attachment receiver structures F1,F2 with which the coupler Q is designed to mate, which can vary as noted above in connection with FIGS. 5A and 5B.

In the illustrated embodiment, for both the left and right coupler portions LP,RP, the second and third ribs 10*b*,10*c* include bosses 91*b*,91*c* that define respective plunger apertures 90*b*,90*c* that are coaxial with respect to the first lock plunger axis PX1. Each first lock plunger L1*a*,L1*b* is slidably supported in a corresponding one of the bosses 91*c* and is selectively movable by its respective rod R1*a*,R1*b* outward to an extended locked position where it extends into and preferably completely spans the inner lock channel K1 so as to be received also in the aperture 90*b* of boss 91*b*. When the coupler body B is mated with the first type of attachment receiver structure F1 with the ears E of the left and right ribs R1 thereof respectively located in the left and right inner lock channels K1, movement of the left and right first lock plungers L1*a*,L1*b* from their retracted unlocked position to their extended locked position will cause the first lock plungers L1*a*,L1*b* to extend through the respective apertures EA of the ears E to prevent withdrawal of the ears E from the inner lock channels K1. Conversely, the first lock plungers L1*a*,L1*b* are also movable from their extended locked positions to retracted unlocked positions where they are at least partially withdrawn from and do not span the left and right inner lock channels K1. In such retracted unlocked position, the first lock plungers L1*a*,L1*b* do not extend into or through the apertures EA of the ears E of the first type of attachment coupling structure F1 so that the ears E of the first type of attachment coupling structure F1 are not captured in the left and right inner lock channels K1 and are freely movable into and out of the left and right inner lock channels K1.

Similarly, in the illustrated embodiment, for both the left and right coupler portions LP,RP, the first and second ribs 10*a*,10*b* include bosses 93*a*,93*b* that define respective plunger apertures 92*a*,92*b* that are coaxial with respect to the second lock plunger axis PX2. The boss 93*b* is also connected to the third rib 10*c* for added strength. Each of the second lock plungers L2*a*,L2*b* is slidably supported in a corresponding one of the bosses 93*b* and is selectively movable by its respective rod R2*a*,R2*b* outward to an extended locked position where it extends into and preferably completely spans the outer lock channel K2 so as to be received in the aperture 92*a* of boss 93*a*. When the coupler body B is mated with the second type of attachment receiver structure F2 with the ears E of the left and right ribs R2 thereof respectively located in the left and right outer lock channels K2, movement of the left and right second lock plungers L2*a*,L2*b* from their retracted unlocked positions to their extended locked positions will cause the second lock plungers L2*a*,L2*b* to extend through the respective apertures EA of the ears E to prevent withdrawal of the ears E from the outer lock channels K2. Conversely, the second lock plungers L2*a*,L2*b* are also movable from their extended locked positions to retracted unlocked positions where they are at least partially withdrawn from and do not span the left and right outer lock channels K2. In such retracted unlocked position, the second lock plungers L2*a*, L2*b* do not extend into or through the apertures EA of the ears E of the second type of attachment coupling structure F2 so that the ears E of the second type of attachment coupling structure F2 are not captured in the left and right outer lock channels K2 and are freely movable into and out of the left and right outer lock channels K2.

When the coupler Q is fully mated with the first type of attachment receiver structure F1 as described above, the eye apertures EA of the left and right female ribs R1 are respectively located in the left and right inner locking channels K1 and are aligned with the first lock plungers L1*a*,L1*b*, and movement of the left and right first lock plungers L1*a*,L1*b* from their retracted (unlocked) positions to their extended (locked) positions will cause the first lock plungers L1*a*,L1*b* to extend through the aligned eye apertures EA to capture the ribs R1 to the coupler body B for use of the bucket or other attachment to which the ribs R1 are connected. Likewise, when the coupler Q is fully mated with the second type of attachment receiver structure F2 as described above, the eye apertures EA of the left and right female ribs R2 are respectively located in the left and right outer locking channels K2 and are aligned with the second lock plungers L2*a*,L2*b*, and movement of the left and right second plungers L2*a*,L2*b* from their retracted positions to their extended positions will cause the second lock plungers L2*a*,L2*b* to extend through the aligned eye apertures EA to capture the ribs R2 to the coupler body B for use of the bucket or other attachment to which the ribs R2 are connected. When the first lock plungers L1*a*,L1*b* and second lock plungers L2*a*,L2*b* are in their retracted (unlocked) positions, the coupler body B is able to be freely mated with or separated from either the first type of attachment receiver structure F1 or the second type of attachment receiver structure F2, because the first lock plungers L1*a*,L1*b* and second lock plungers L2*a*,L2*b* do not obstruct the inner and outer locking channels K1,K2 for either the left or right coupler portion LP,RP.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A loader coupler comprising:

a body comprising a front region, a rear region, an upper region, a lower region, and left and right lateral sides, a tilt actuator pin-on location, and left and right arm pin-on locations;

left and right laterally spaced-apart inner rib mounts provided on the body and adapted to mate respectively with left and right ribs of a first type of attachment receiver structure;

left and right inner locking regions defined by the body and vertically aligned with the left and right inner rib mounts, respectively;

left and right laterally spaced-apart outer rib mounts provided on the body and adapted to mate respectively with left and right ribs of a second type of attachment receiver structure;

left and right outer locking regions defined by the body and vertically aligned with the left and right outer rib mounts, respectively;

a lock system connected to said body, said lock system comprising:

a first actuator comprising both left and right first lock plungers that each move in response to fluid pressure in said first actuator between locked and unlocked positions along a first plunger axis;

a second actuator comprising both left and right second lock plungers that each move in response to fluid pressure in said second actuator between locked and unlocked positions along a second plunger axis that is parallel and spaced-apart from said first plunger axis;

wherein:

said left and right first lock plungers extend into said left and right inner locking regions when located in their locked positions;

said left and right first lock plungers are at least partially withdrawn from said left and right inner locking regions when located in their unlocked positions;

said left and right second lock plungers extend into said left and right outer locking regions when located in their locked positions; and, said left and right second lock plungers are at least partially withdrawn from said left and right outer locking regions when located in their unlocked positions.

2. The loader coupler as set forth in claim 1, wherein said left and right first lock plungers are movable independently relative to said left and right second lock plungers.

3. The loader coupler as set forth in claim 1, wherein said left and right first lock plungers are movable in unison with said left and right second lock plungers.

4. The loader coupler as set forth in claim 1, wherein:

said left outer locking region is defined between first and second vertical ribs of a left portion of said body, and said left outer rib mount extends between said first and second vertical ribs of said left portion of said body;

said right outer locking region is defined between first and second vertical ribs of a right portion of said body, and said right outer rib mount extends between said first and second vertical ribs of said right portion of said body.

5. The loader coupler as set forth in claim 4, wherein:

said left inner locking region is defined between said second vertical rib and a third vertical rib of said left portion of said body, and said left inner rib mount extends between said second and third vertical ribs of said left portion of said body;

said right inner locking region is defined between said second vertical rib and a third vertical rib of said right portion of said body, and said right inner rib mount extends between said second and third vertical ribs of said right portion of said body.

6. The loader coupler as set forth in claim 5, wherein:

said left and right first lock plungers extend between said second and third ribs of said left and right portions of said body, respectively, when in their locked positions; and, said left and right second lock plungers extend between said first and second ribs of said left and right portions of said body, respectively, when in their locked positions.

7. The loader coupler as set forth in claim 6, further comprising a face plate connected to said front region of said body, said face plate connected to and extending between said second vertical rib of said left portion of said body and said second vertical rib of said right portion of body.

8. The loader coupler as set forth in claim 7, wherein said face plate comprises left and right inner lock channel openings that open respectively through said face plate and into said left and right inner locking regions.

9. The loader coupler as set forth in claim 8, wherein said face plate comprises left and right inner stop surfaces located adjacent said left and right inner lock channel openings and adapted to be abutted by left and right stops of an associated first type of attachment receiver structure.

10. The loader coupler as set forth in claim 9, wherein said face plate comprises left and right outer stop surfaces located adjacent said left and right outer locking regions and adapted to be abutted by left and right stops of an associated second type of attachment receiver structure.

11. The loader coupler as set forth in claim 5, wherein:

said left arm pin-on location is located between the first and second vertical ribs of the left portion of the body, aligned with and spaced from said left outer rib mount; and, said right arm pin-on location is located between the first and second vertical ribs of the right portion of the body, aligned with and spaced from said right outer rib mount.

12. The loader coupler as set forth in claim 11, wherein said tilt actuator pin-on location is located between a fourth vertical rib of the left portion and a fourth vertical rib of the right portion, said tilt actuator pin-on location located centrally between the left and right arm pin-on locations.

* * * * *